US006746014B2

(12) United States Patent
Endo et al.

(10) Patent No.: US 6,746,014 B2
(45) Date of Patent: Jun. 8, 2004

(54) SHEET-LIKE MATERIAL GUIDING DEVICE OF A SHEET-FED PRINTING PRESS

(75) Inventors: Yutaka Endo, Chiba (JP); Akihiko Takenouchi, Chiba (JP); Teruo Tsunoda, Toride (JP)

(73) Assignee: Komori Corporation, Tokyo (JP)

( * ) Notice: Subject to any disclaimer, the term of this patent is extended or adjusted under 35 U.S.C. 154(b) by 176 days.

(21) Appl. No.: 10/067,778

(22) Filed: Feb. 8, 2002

(65) Prior Publication Data

US 2002/0108516 A1 Aug. 15, 2002

(30) Foreign Application Priority Data

Feb. 9, 2001 (JP) ..... 2001-033207

(51) Int. Cl.[7] ..... B65H 29/04; B41F 1/30
(52) U.S. Cl. ..... 271/204; 271/183; 101/408
(58) Field of Search ..... 101/408, 246; 271/183, 268, 204, 205

(56) References Cited

U.S. PATENT DOCUMENTS

| | | | | | |
|---|---|---|---|---|---|
| 4,013,284 | A | * | 3/1977 | Demetre | 271/183 |
| 4,225,129 | A | * | 9/1980 | Zimmermann et al. | 271/204 |
| 4,305,331 | A | * | 12/1981 | Colapinto | 101/123 |
| 4,479,645 | A | * | 10/1984 | Pollich | 271/183 |
| 4,968,017 | A | * | 11/1990 | Depetris | 271/12 |
| 5,259,608 | A | * | 11/1993 | Pollich | 271/183 |
| 5,263,415 | A | * | 11/1993 | Pollich | 101/232 |
| 5,329,852 | A | | 7/1994 | Bolza-Schuenemann et al. | |
| 5,368,148 | A | * | 11/1994 | Orlandini | 194/207 |
| 5,582,400 | A | * | 12/1996 | Seydel | 271/176 |
| 5,797,321 | A | | 8/1998 | Shibata | |
| 5,974,683 | A | * | 11/1999 | Shibata | 34/88 |
| 5,979,701 | A | * | 11/1999 | Wenzel et al. | 221/183 |
| 6,098,976 | A | * | 8/2000 | Gieser et al. | 271/183 |
| 6,176,482 | B1 | * | 1/2001 | Reinhard et al. | 271/227 |
| 6,241,238 | B1 | * | 6/2001 | Aoki | 271/183 |
| 6,257,139 | B1 | * | 7/2001 | Schaede | 101/232 |
| 6,315,287 | B1 | * | 11/2001 | Hirth et al. | 271/182 |
| 6,648,326 | B2 | * | 11/2003 | Hieb | 271/183 |
| 2003/0123107 | A1 | * | 7/2003 | Sheng et al. | 358/498 |

FOREIGN PATENT DOCUMENTS

| | | | | |
|---|---|---|---|---|
| JP | 5-254091 A | | 10/1993 | |
| JP | 8-43317 | * | 2/1996 | 271/183 |
| JP | 10-34891 A | | 2/1998 | |

* cited by examiner

*Primary Examiner*—Donald P. Walsh
*Assistant Examiner*—Daniel K Schlak
(74) *Attorney, Agent, or Firm*—Birch, Stewart, Kolasch & Birch, LLP

(57) ABSTRACT

A sheet-fed printing press comprises a running transport chain, gripper devices supported by the transport chain and each having a gripper and a gripper pad for gripping a sheet, an inspection device for inspecting the sheet gripped and transported by the gripper devices, and a suction table having a guide surface for guiding the sheet at a position of inspection, and suction holes for spreading the sheet along the guide surface. Suction taper plates each having an inclined surface, which gradually decreases the distance between the gripper pads and the guide surface from an upstream side toward a downstream side of the guide surface in the sheet transport direction, are provided on the downstream side of the guide surface at predetermined intervals in the sheet width direction. Grooves, through which the grippers pass, are interposed among the suction taper plates.

7 Claims, 4 Drawing Sheets

SHEET-LIKE MATERIAL GUIDING DEVICE OF A SHEET-FED PRINTING PRESS

The entire disclosure of Japanese Patent Application No. 2001-33207 filed on Feb. 9, 2001 including specification, claims, drawings and summary is incorporated herein by reference in its entirety.

BACKGROUND OF THE INVENTION

1. Field of the Invention

This invention relates to a sheet-fed printing press equipped with an inspection unit for checking the printing quality of a sheet-like material.

2. Description of the Related Art

Generally, a sheet-fed printing press is equipped with an inspection unit for checking the printing quality of a sheet (or sheet-like material) printed by a printing unit. In the inspection unit, a sheet being transported by a transport chain toward a pile board of a delivery unit after being printed by the printing unit is sucked onto a guide surface of a suction table. On the guide surface, the sheet is spread as uniformly as possible (so that it becomes substantially wrinkle/crease fuss), and the printed surface of the sheet is photographed by a picture taking device, such as a CCD camera. A control device compares signals from the picture taking device with prescribed quality standards. Sheets which meet the quality standards, and sheets which do not meet the quality standards are separated, and delivered onto predetermined pile boards (see, for example, Japanese Unexamined Patent Publication No. 5-254091).

The above-described sheet-fed printing press, however, has required that a clearance needs to be provided between the guide surface of the suction table and the front ends of gripper devices (chain gripper devices), which are supported by the transport chain to grip the sheet, in order that the gripper devices and the suction table will not interfere with each other during travel of the gripper devices.

As shown in FIGS. 4(*a*) and 4(*b*), a printed sheet W travels on a guide surface 101 of the suction table, with a leading edge Wa of the sheet W being gripped by a gripper 100*a* and a gripper pad 100*b* of a gripper device 100. If the sucking force of the suction table is weak when the sheet W is photographed with a CCD camera 102 of an inspection unit, the sheet W cannot be spread on (sucked by) the guide surface 101 of the suction table. As a result, the sheet makes an unstable motion, thereby affecting the picture taking of the CCD camera 102 of the inspection unit. To avoid this situation, the sucking force of the suction table needs to be increased in order to spread (suck) the sheet W reliably on (onto) the guide surface 101 of the suction table, as shown in FIGS. 4(*a*) and 4(*b*).

In taking a picture of the sheet W by the CCD camera 102 of the inspection unit while increasing the sucking force of the suction table, there is a distance between the gripper pad 100*b* and the guide surface 101, as stated earlier, and the sheet W is transported in a state as shown in FIG. 4(*a*) or 4(*b*), although the state of transport differs according to each sheet W. Assume that the sheet W is to be photographed by the CCD camera 102 in the state of FIG. 4(*a*). Compared with the sheet W transported in the state of FIG. 4(*a*), the sheet W transported in the state of FIG. 4(*b*) falls into a state such that a trailing edge Wb of the sheet W extends beyond a detection area E (i.e., the trailing edge Wb recedes). Thus, the sheet W may be judged to be a defective sheet, although it is a normal sheet. (A similar problem occurs in the opposite case, in which the trailing edge Wb enters the detection area E too much.) On the other hand, the leading edge Wa of the sheet W transported in the state of FIG. 4(*a*) is bent in the form of a crank (nearly at right angles), thus making sheet jogging poor at the delivery unit.

As a countermeasure, Japanese Unexamined Patent Publication No. 10-034891 proposes a technique which comprises: providing grooves, corresponding to the travel paths of the grippers, in the suction table; designing the transport path of the sheet, which is transported by the gripper devices (concretely, the transport path is at the same height as the height of the gripper pad of the gripper device), to be at nearly the same height as the guide surface of the suction table; and inserting the grippers of the gripper devices into the grooves to avoid the interference of the grippers with the suction table, while causing the entire surface of the sheet gripped by the gripper devices to be sucked onto and spread along the guide surface to prevent the instable motion of the sheet, thereby decreasing inspection errors.

With the sheet-fed printing press disclosed in Japanese Unexamined Patent Publication No. 10-034891, however, while the sheet is traveling on the guide surface of the suction table, the sheet is rubbed against the edges of the grooves and scratched thereby. Particularly in a perfecting press, the sheet is instantaneously turned into a wasted sheet. Moreover, the sheet is deformed into a corrugated shape because of the grooves discretely present in a sheet width direction. Thus, high accuracy inspection could not be performed.

SUMMARY OF THE INVENTION

The present invention has been proposed in consideration of the above-described circumstances. It is the object of the invention to provide a sheet-fed printing press capable of effectively suppressing behaviors of a leading edge of a sheet-like material gripped by gripper devices to make a highly accurate inspection.

According to the present invention, there is provided a sheet-fed printing press comprising:

- a transport chain;
- gripper devices supported by the transport chain and each having a gripper and a gripper pad for gripping a sheet-like material;
- an inspection device for inspecting the sheet-like material gripped and transported by the gripper devices; and
- a sheet-like material guide member having a guide surface for guiding the sheet-like material at a position of inspection by the inspection device, and a suction hole for spreading the sheet-like material along the guide surface, and wherein
- an inclined portion, which gradually decreases a distance between the gripper pads and the guide surface from an upstream side toward a downstream side of the guide surface in a sheet-like material transport direction, is provided on the downstream side of the guide surface, and
- groove portions, through which the grippers pass, are formed in the inclined portion.

According to this feature, behaviors of the leading edge of the sheet-like material gripped by the gripper devices can be suppressed effectively. Thus, inspection errors can be decreased to increase the accuracy of inspection. Moreover, the sheet-like material is minimally deformed, effectively preventing scratches and performing satisfactory sheet jogging.

In the sheet-fed printing press, a suction hole for spreading the sheet-like material along a guide surface of the inclined portion may be provided in the guide surface or groove portions of the inclined portion. Thus, the leading edge of the sheet-like material is further stabilized to increase the accuracy of inspection.

In the sheet-fed printing press, an inspection surface for inspection by the inspection device may comprise the guide surface of the sheet-like material guide member and the guide surface of the inclined portion.

In the sheet-fed printing press, the inclined portion may comprise strip-shaped portions disposed at predetermined intervals in a sheet width direction, and the predetermined intervals may define the groove portions.

In the sheet-fed printing press, the inclined portion may be supported by the guide surface of the sheet-like material guide member.

In the sheet-fed printing press, the transport chain may support a plurality of gripper devices.

In the sheet-fed printing press, the sheet-like material guide member may include a plurality of groove portions.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

A preferred embodiment of a sheet-fed printing press according to the present invention will now be described in detail with reference to the accompanying drawings, which in no way limit the invention.

Figure 1:
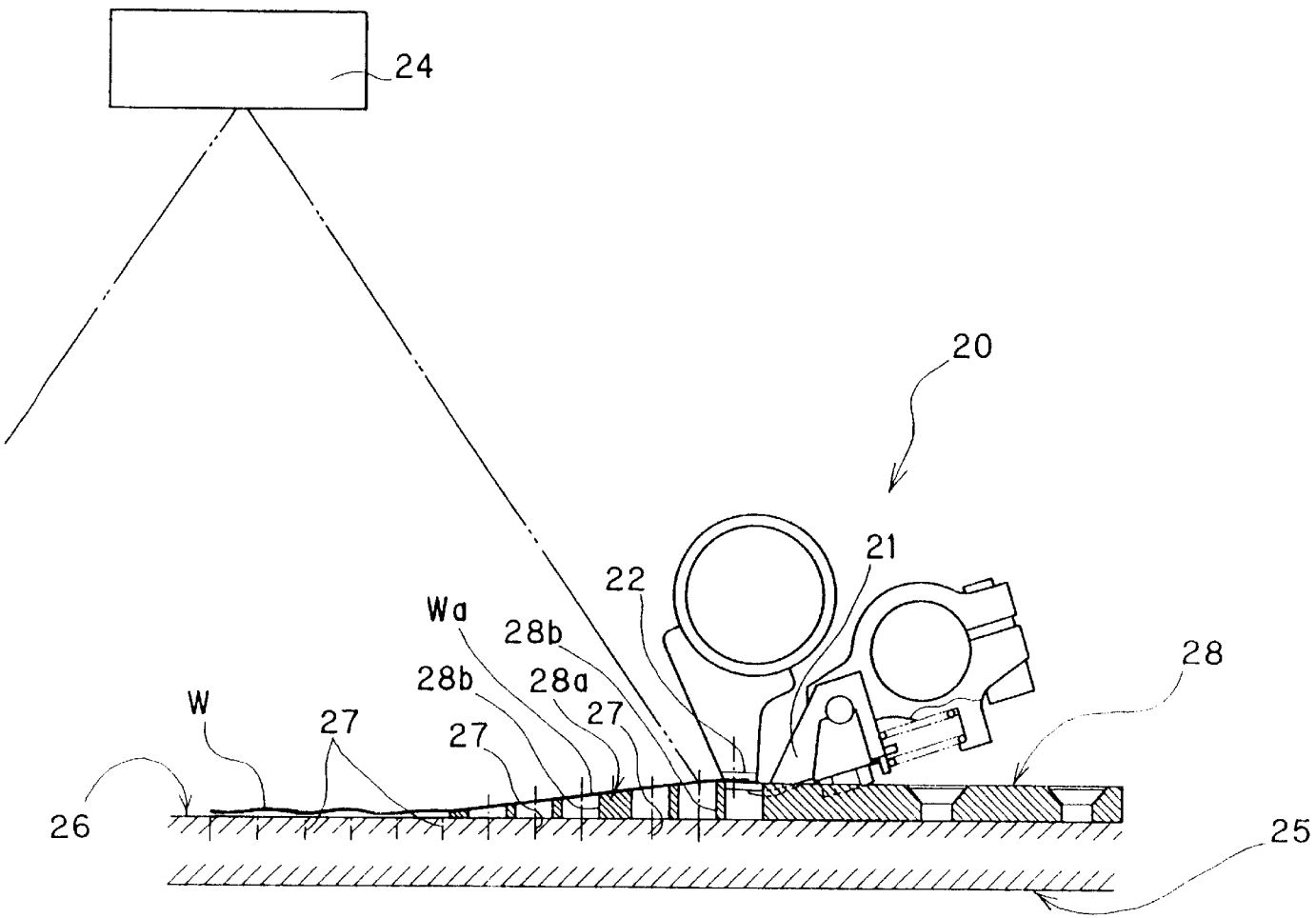
FIG. 1 is an essential enlarged sectional side view of an inspection station showing an embodiment of the present invention.
Figure 2:
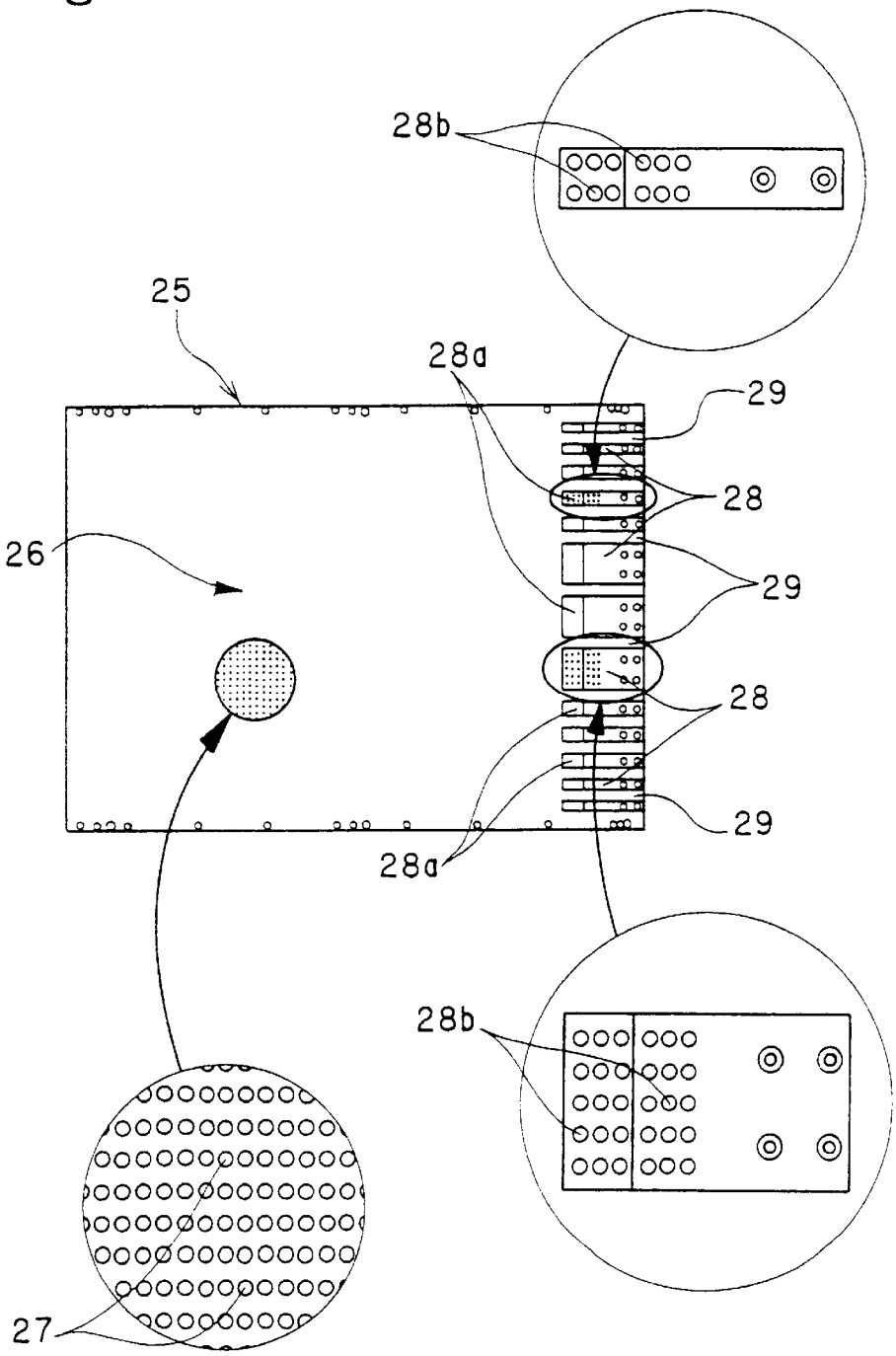
FIG. 2 is a plan view of a suction table according to the embodiment.
Figure 3:
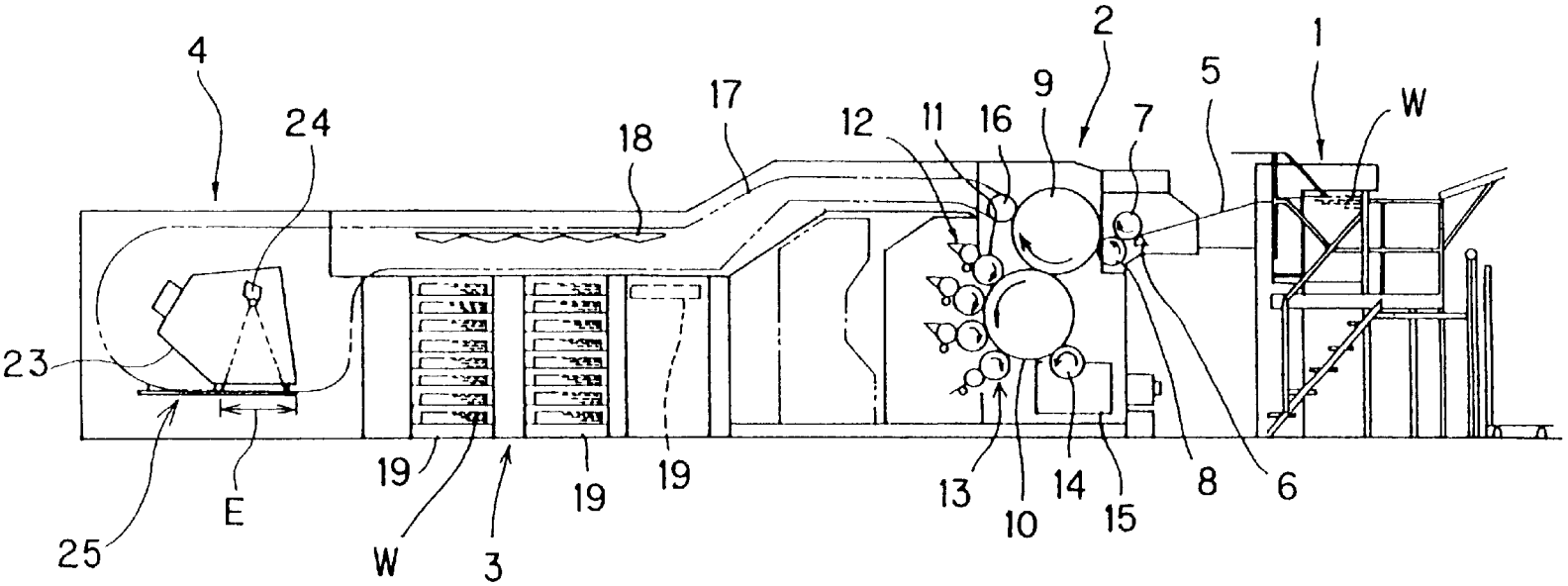
FIG. 3 is an entire configurational side view of a sheet-fed printing press according to the embodiment.

FIG. 1 is an essential enlarged sectional side view of an inspection station showing an embodiment of the present invention. FIG. 2 is a plan view of a suction table according to the embodiment. FIG. 3 is an entire configurational side view of a sheet-fed printing press according to the embodiment.

As shown in FIG. 3, the sheet-fed printing press is composed of a feeding unit 1, a printing unit 2, a delivery unit 3, and an inspection station 4. In the feeding unit 1, stacked sheets (sheet-like materials) Ware transferred, one by one, to transfer cylinders 7 and 8 via a feeder board 5 and a swing arm shaft pregripper 6, and then transferred from the transfer cylinder 8 to an impression cylinder 9 (a triple-size cylinder) of the printing unit 2.

In the printing unit 2, an intaglio cylinder 10 (a triple-size cylinder) is located downstream of the transfer cylinder 8 in a rotating direction of the impression cylinder 9, and is in contact with the impression cylinder 9. Three chablon rollers 11 are located at predetermined intervals and downstream of the impression cylinder 9 in a rotating direction of the intaglio cylinder 10, and are in contact with the intaglio cylinder 10 in a circumferential direction of the intaglio cylinder 10. Inking devices 12 are in contact with the chablon rollers 11.

A prewiping device 13 is located downstream of the chablon rollers 11 in a rotating direction of the intaglio cylinder 10, and is in contact with the intaglio cylinder 10. A wiping roller 14 is located downstream of the prewiping roller 13 in a rotating direction of the intaglio cylinder 10, and is in contact with the intaglio cylinder 10. The wiping roller 14 has a lower half thereof immersed in a wiping tank 15 containing a wiping liquid.

A delivery cylinder 16 is located downstream of the intaglio cylinder 10 in a rotating direction of the impression cylinder 9, and is in contact with the impression cylinder 9. A transport chain 17, which comprises a plurality of gripper devices (chain gripper devices) 20 (see FIG. 1) attached at predetermined intervals for receiving the sheet W from the impression cylinder 9, is passed over the delivery cylinder 16. The transport chain 17 runs while being guided by a chain guide (not shown), brings the sheet W, which has been received from the impression cylinder 9, to an air duct 18 for drying, and transports the dried sheet W onto a pile board 19 of the delivery unit 3 through the inspection station 4.

As shown in FIG. 1, the gripper device 20 has a gripper 21 and a gripper pad 22 for gripping the sheet W. In the inspection station 4, a CCD camera 24 is disposed, together with a lighting instrument (not shown) within an inspection unit 23 (see FIG. 3) located above the transport chain 17. A suction table 25, as a sheet-like material guide member, is located below the transport chain 17 and opposed to the inspection unit 23. The suction table 25 is disposed horizontally along the transport chain 17 and over a predetermined length.

The suction table 25 has a guide surface 26 for guiding the sheet W at a position of photographing by the CCD camera 24 (see an inspection area E in FIG. 3), and many suction holes 27 for causing the sheet W to be sucked onto and spread along the guide surface 26. These suction holes 27 communicate with a vacuum source (not shown) by predetermined means.

As shown in FIG. 2 as well, suction taper plates 28 are provided on a downstream side of the guide surface 26 of the suction table 25 (on the right end side of the inspection area E in the drawing). The suction tape plate 28 serves as an inclined portion having an inclined surface 28*a* which gradually decreases the distance between the gripper pad 22 and the guide surface 26 from an upstream side toward a downstream side of the guide surface 26 in the sheet transport direction.

The inclined surface 28*a* is set at an angle which does not affect the focal point of the CCD camera 24. The maximum height of the inclined surface 28*a*, namely, the height of the flat surface of the suction taper plate 28, is set to be a height at which this flat surface is as close as possible to the gripper pad 22.

The suction taper plate 28 is in the form of a strip, and the respective suction taper plates 28 are bolted on to the suction table 25, and disposed at predetermined intervals in the sheet width direction so as to evade the travel paths of the gripper devices 20 while avoiding interference with the gripper devices 20 (strictly, the grippers 21). That is, the suction taper plates 28 are configured such that many grooves 29, through which the grippers 21 pass, are formed beside the suction taper plates 28 as the inclined portions.

Air intake holes 28*b* communicating with the suction holes 27 are formed in the inclined surface 28*a* of the suction taper plate 28, but need not be formed. In the illustrated embodiment, the suction holes 27 correspond to the grooves 29 as well.

When the sheet W is fed from the feeding unit 1 onto the feeder board 5 in the thus configured intaglio printing press, the sheet W is transferred by the swing arm shaft pregripper 6 to the transfer cylinder 7, and then transferred to the impression cylinder 9 via the transfer cylinder 8. When ink is supplied from the inking device 12 to the intaglio cylinder 10 via the chablon roller 11, a surplus of the ink is removed by the prewiping device 13 and the wiping roller 14, whereafter the remaining ink is transferred to the sheet W held on the impression cylinder 9. The printed sheet W is transferred from the impression cylinder 9 to the delivery cylinder 16, where the sheet W is transferred to the gripper devices 20 of the transport chain 17. Then, the sheet W is transported to the inspection station 4 by the transport chain 17 running along the chain guide.

The sheet W traveling inside the inspection station 4 is sucked onto the suction table 25, and with its posture being corrected, travels on the table 25. At this time, the CCD camera 24 photographs the printed surface of the sheet W, and a control device (not shown) compares signals from the CCD camera 24 with the prescribed quality standards to evaluate the printing quality of the sheet W. The sheet W, whose printing quality has been inspected in this manner, further travels away from the suction table 25. If judged to meet the quality standards, the sheet is delivered onto the pile board 19 for normal sheets. If judged not to meet the quality standards, the sheet is delivered onto the pile board 19 for defective sheets.

In the present embodiment, most of the sheet W travels while being sucked onto and spread along the grooveless guide surface 26 of the suction table 25. Thus, unlike the sheet-fed printing press disclosed in Japanese Unexamined Patent Publication No. 1998-34891, it does not happen that the sheet W is rubbed against the edges of the grooves and scratched thereby. Nor is the sheet W deformed into a corrugated shape because of the grooves present at predetermined intervals in the sheet width direction.

Figure 4:
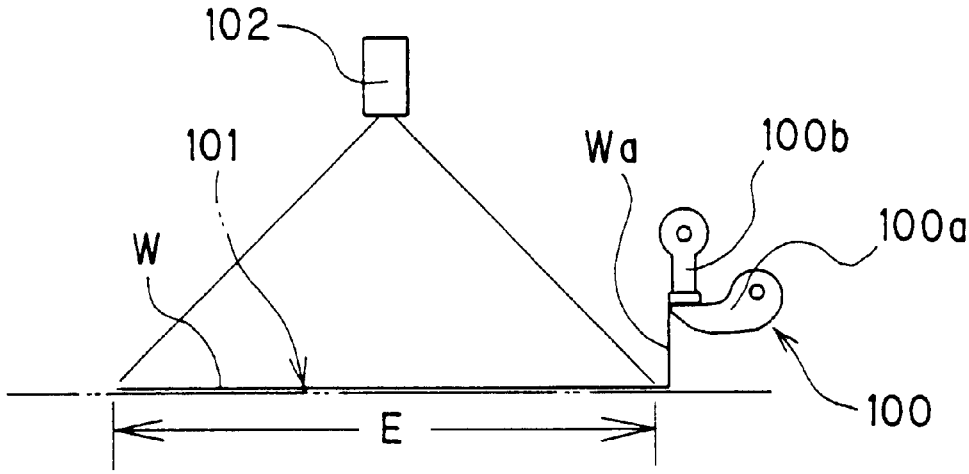
Fig. 4 (a) PRIOR ART
FIGS. 4(*a*) and 4(*b*) are explanatory drawings showing problems with a conventional inspection unit.
Figure 4:
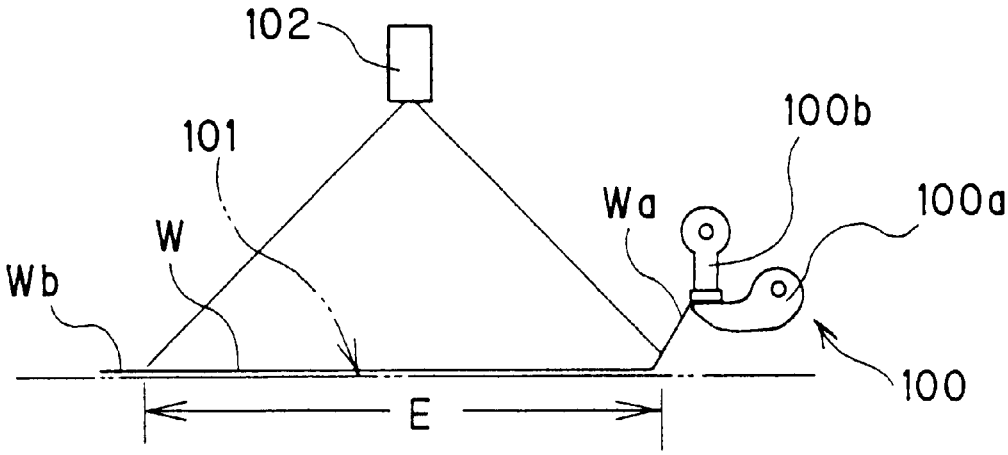
Fig. 4 (b) PRIOR ART

Furthermore, little distance exists between the gripper pad 22 and the guide surface 26 on the right end side, in the drawing, of the inspection area E by the CCD camera 24. Besides, the leading edge Wa of the sheet W gripped by the gripper devices 20 travels while being sucked onto and moved along the inclined surface 28*a* of the suction taper plate 28. Thus, a stable transport state of the sheet W is obtained, without differences in the transport state according to each sheet W transported, as shown in FIGS. 4(*a*) and 4(*b*). In other words, there is none of the problem that the leading edge Wa of the sheet W is bent in the form of a crank (nearly at right angles) as in FIG. 4(*a*), thus resulting in poor jogging of the sheets at the delivery unit 3. Also, it is avoided that the leading edge Wa of the sheet W changes from the perpendicularly bent state in FIG. 4(*a*) to the obliquely bent state in FIG. 4(*b*), whereby the trailing edge Wb of the sheet W goes beyond the detection area E; or that the leading edge Wa of the sheet W changes from the state in FIG. 4(*b*) to the state in FIG. 4(*a*), whereby the trailing edge Wb of the sheet W enters the detection area E too much.

As described above, inspection can be conducted, with the sheet W being in a constantly stable state. Thus, inspection errors can be decreased to increase the reliability of the inspection device. Furthermore, scratches on the sheet W are eliminated to decrease wasted sheets, and deformation is also resolved to make jogging of sheets satisfactory. In the present embodiment, moreover, the taper plates 28 are bolted on to the suction table 25, so that the taper plates can be easily mounted on the conventional printing press.

In the present embodiment, the CCD camera 24 is provided above, and the guide surface 26 is provided below, as shown in FIG. 1. However, the CCD camera 24 may be provided below, and the guide surface 26 may be provided above.

While the present invention has been described by the present embodiment, it is to be understood that the invention is not limited thereto, but may be varied in many other ways. For example, the suction taper plates may be formed integrally with the suction table. Alternatively, an integral taper plate having the same width as that of the suction table may be formed, and grooves may be formed therein. Besides, the present invention can be applied not only to an intaglio printing press, but also to other printing press, such as an offset printing press. Such variations are not to be regarded as a departure from the spirit and scope of the invention, and all such modifications as would be obvious to one skilled in the art are intended to be included within the scope of the appended claims.

What is claimed is:

1. A sheet-fed printing press, comprising:

a transport chain;

a gripper device supported by the transport chain and having a gripper and a gripper pad for gripping a sheet-like material;

an inspection device for inspecting the sheet-like material gripped and transported by the gripper device;

a sheet-like material guide member having a guide surface for guiding the sheet-like material at a position of inspection by the inspection device, and a suction hole for spreading the sheet-like material along the guide surface, the sheet-like material guide member including, an inclined portion, which gradually decreases a distance between the gripper pad and the guide surface from an upstream side toward a downstream side of the guide surface in a sheet-like material transport direction, is provided on the downstream side of the guide surface, and a groove portion, through which the gripper passes, is formed in the inclined portion.

2. The sheet-fed printing press of claim 1, wherein a suction hole for spreading the sheet-like material along a guide surface of the inclined portion is provided in one of the guide surface and the groove portion of the inclined portion.

3. The sheet-fed printing press of claim 1, wherein an inspection surface for inspection by the inspection device includes the guide surface of the sheet-like material guide member and the guide surface of the inclined portion.

4. The sheet-fed printing press of claim 1, wherein the sheet-like material guide member includes a plurality of groove portions, and the inclined portion includes strip-shaped portions disposed at predetermined intervals in a sheet width direction, and the predetermined intervals define the groove portions.

5. The sheet-fed printing press of claim 1, wherein the inclined portion is supported by the guide surface of the sheet-like material guide member.

6. The sheet-fed printing press of claim 1, wherein the transport chain supports a plurality of gripper devices.

7. The sheet-fed printing press of claim 1, wherein the sheet-like material guide member includes a plurality of groove portions.

* * * * *